US005192183A

United States Patent [19]

Wilkinson

[11] Patent Number: 5,192,183

[45] Date of Patent: Mar. 9, 1993

[54] LAMINAR FLOW FANS

[75] Inventor: Philip R. C. Wilkinson, Southhampton, United Kingdom

[73] Assignee: International Business Machines Corporation, Armonk, N.Y.

[21] Appl. No.: 751,425

[22] Filed: Aug. 28, 1991

[30] Foreign Application Priority Data

Sep. 11, 1990 [EP] European Pat. Off. ..... 90309938.0

[51] Int. Cl.[5] ..... F01D 1/36

[52] U.S. Cl. ..... 415/90; 416/198 R; 416/204 R; 403/348

[58] Field of Search ..... 416/198 R, 200 R, 201 R, 416/201 A, 204 R, 223 B, 244 R; 415/90; 403/348, 349

[56] References Cited

U.S. PATENT DOCUMENTS

| | | | |
|---|---|---|---|
| 2,087,834 | 7/1937 | Brown et al. | 415/90 |
| 2,626,135 | 1/1953 | Serner | 416/200 |
| 2,632,598 | 3/1953 | Wales | 415/90 |
| 3,007,311 | 11/1961 | Amero | 415/90 |
| 3,275,223 | 9/1966 | Fowell | 415/90 |
| 3,306,588 | 2/1967 | Reid | 416/204 |
| 4,255,081 | 3/1981 | Oklejas et al. . | |

FOREIGN PATENT DOCUMENTS

| | | | |
|---|---|---|---|
| 599519 | 6/1934 | Fed. Rep. of Germany . | |
| 1280348 | 11/1961 | France . | |
| 1461776 | 1/1977 | United Kingdom | 415/90 |
| 2126653 | 3/1984 | United Kingdom . | |

*Primary Examiner*—Edward K. Look
*Assistant Examiner*—James A. Larson
*Attorney, Agent, or Firm*—Richard E. Billion

[57] ABSTRACT

A laminar flow fan is described comprising a number of fan elements, such as disks, carried on support posts. In a preferred embodiment, each element has a non-circular central aperture. The shape of the aperture provides sufficient clearance for the elements to be placed over the support posts in a first position. Rotation of the elements into a second position with respect to the support posts latches the elements into engagement with the posts, thereby maintaining the elements in this second position.

13 Claims, 3 Drawing Sheets

LAMINAR FLOW FANS

FIELD OF THE INVENTION

The present invention relates to fans and, in particular, to laminar flow fans.

BACKGROUND OF THE INVENTION

Laminar flow fans are commonly used for impelling a fluid medium (a liquid or gas). In particular, they are suited to low flow, high back pressure forced air cooling of electrical apparatus when low acoustic fan noise is required. Typically, these fans comprise an assembly of parallel annular or frusto-conical elements, mounted spaced apart and face to face about a common rotation axis. In operation, the assembly is rotated about this axis by a suitable motor; the fluid is drawn in at the center of the assembly, impelled towards the outer edges of the disks by viscous interaction with the surface of the disks, and is finally expelled at the periphery of the disk assembly.

The fan elements are usually held together by bolts or rods passing through the elements. At least three bolts, angularly spaced around the assembly, are used, in order to provide enough points of support to maintain the elements parallel to one another. During manufacture, one element is placed onto the mounting bolts, followed by a number of spacers (one for each bolt), and then by the next element and so on. When all of the elements and spacers are in place, the assembly is held together by fastening a corresponding nut to each of the mounting bolts.

The above method can be time consuming and expensive. Several intricate process steps are required to place each element and set of spacers into position, and a large number of small components are required.

A development is described in GB 2126653, in which the first step is temporarily to hold the fan elements in the required spaced apart relationship using a suitable jig. A plurality of holes are provided in each element; these are aligned with the holes in other elements when the elements are held in the jig. Spirally fluted tubes or rods are then inserted through the holes, passing through each element in turn. The fluted tubes are arranged to grip the periphery of the holes and so to hold the disks rigidly in the required relationship. In this arrangement, no spacers are required.

A problem with both of the above methods is that the mounting bolts, tubes or rods pass through the 'active area' of the fan elements. This can cause turbulence in the air flow, which can reduce the efficiency of the fan and increase the fan noise. The turbulence problem is exacerbated when spacers are used between the fan elements.

It is a constant aim to decrease manufacturing costs and to reduce the number of separate components required during a manufacturing process.

SUMMARY OF THE INVENTION

Accordingly, the present invention provides a laminar flow fan comprising: a plurality of fan elements, each having a central aperture; and a support member passing through aligned apertures in each element; characterized in that relative rotation of the support member from a first position to a second position with respect to the elements fastens the support member to an aperture edge in each element, thereby maintaining the support member and elements in the second relative position.

A laminar flow fan, according to the invention, may be assembled very easily; only one simple rotation operation is required to attach the fan elements to the support members.

It will be appreciated that the rotation of the support member can be about the axis of the support member, about the center of the central aperture, or about another suitable axis. It will be clear that rotating the elements while holding the support member still can be equivalent to rotating the support member while holding the elements in a fixed position.

Spacers could be used to separate the fan elements. However, it is preferred instead that the support member includes locating slots to locate and maintain the fan elements in a spaced apart relationship. In this arrangement, no spacers are required; this reduces the number of separate components used to manufacture the fan, and can lead to reduced turbulence during operation of the fan.

The means by which the support member fastens to the elements may take many different forms. For example, a resiliently mounted detent on the support member could engage with a corresponding indentation in the element. An alternative is for the aperture, through which the support member passes, to be shaped such that the rotation from the first to second positions causes the support member to be forced against one or more edges of the aperture. The support member and element are then maintained in the second position by frictional interaction. However, it is preferred that a notched aperture is used. When the rotation from first to second relative position is carried out in this arrangement, the support member is forced past a local narrowing of the corresponding aperture and into a notch in the aperture edge. The arrangement can be designed such that although the member and element are under temporary stress during assembly of the fan, they are no longer under stress once the member is installed in its corresponding notch.

In order to reduce the number of different components required the during the manufacture of the fan, it is preferred that the fan elements are identical to one another. However, it would be possible to construct a fan according to the invention from different sized or shaped elements, or elements having non-identical apertures.

The support member may be a rod, tube, bar, frame or any suitable shape. Preferably, though, the support member has an elongate, aerodynamic, cross section. A support member of this type may individually be oriented along the direction of fluid flow past the member during operation of the fan. Again, this can reduce turbulence in the fluid during fan operation.

Although the support member may pass through a dedicated fastening aperture in the fan elements, it is preferred that the support member passes through the central aperture of each element. This use of the central aperture as the fastening aperture reduces the problem of the support member interrupting the flow of fluid across the elements. The turbulence and fan noise are, therefore, reduced and the fan's efficiency may be increased. Clearly, in this case, a non-circular central aperture is required.

In a preferred embodiment, a plurality of support members are employed, which are preferably attached to a common substructure such as a particular fan element or the fan motor housing. Further bracing may be used to strengthen the support member assembly. Although each of these members could fasten to individual apertures, it is preferred (for reduced turbulence and improved ease of manufacture) that the plurality of members all fasten to a common aperture, such as the central aperture. Again, in this situation, the central aperture must be non-circular.

Finally, although many different shapes of fan element could be used, it is advantageous to use elements having rotational symmetry. In operation, such elements cause less turbulence than non-rotationally symmetric elements. In particular, it is preferred that annular or frusto-conical elements are used. Annular elements are used in a preferred embodiment.

BRIEF DESCRIPTION OF THE DRAWINGS

In order that the invention may be fully understood, a preferred embodiment thereof will now be described, by way of example only, with reference to the accompanying drawings in which.

DETAILED DESCRIPTION OF THE PREFERRED EMBODIMENTS

Figure 1:
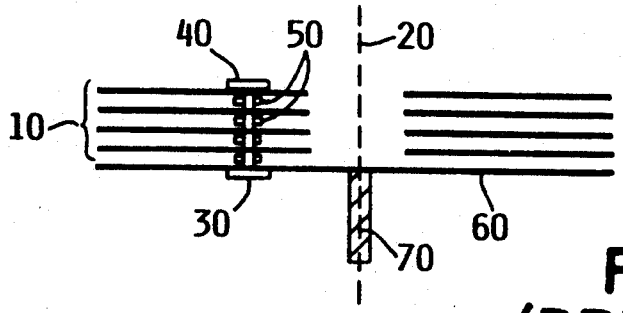
FIG. 1 (PRIOR ART)
FIG. 1 shows a schematic cross section of an assembly of laminar flow fan elements, as known in the prior art.
Figure 2:
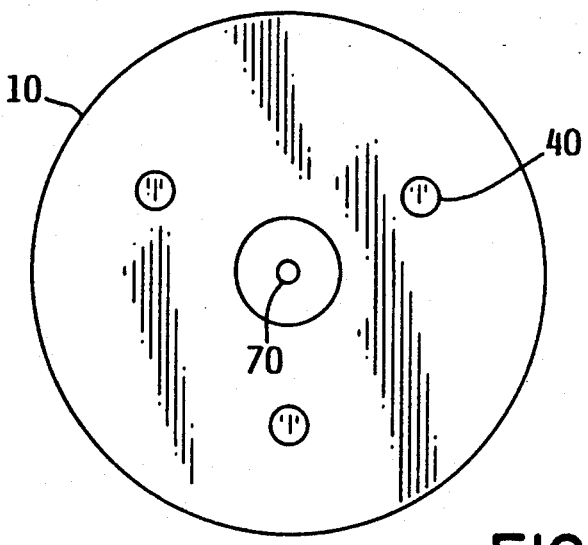
FIG. 2 (PRIOR ART)
FIG. 2 shows a plan view of the prior art fan element assembly of FIG. 1.

Refer now to FIGS. 1 and 2, which show an assembly of fan elements, for use in a prior art laminar flow fan, in schematic cross section and plan view respectively. A plurality of elements 10, each having a central aperture, are held in a spaced apart relationship about a common rotation axis 20.

In FIGS. 1 and 2, the fan elements are shown as annular disks; however, this description would be equally applicable to frusto-conical or other shapes of elements. The disks are commonly made of a plastic material, of the order of 1 mm in thickness, and are typically spaced by 0.5–3 mm in a fan used to impel air. However, all of the dimensions of the fan components and spacings would depend on the performance required from the fan and on the physical properties, in particular the viscosity, of the fluid to be impelled.

The disks are held together by bolts 30 which pass through each disk and are secured by corresponding nuts 40. Between each pair of disks are spacers 50. A non-apertured disk 60 is attached to a drive shaft 70, which in operation is driven by a motor (not shown). In this way the complete assembly of disks may be rotated about axis 20. A typical operational speed for this type of fan, when used to impel air, might be between several hundred and perhaps three thousand revolutions per minute.

Figure 3:
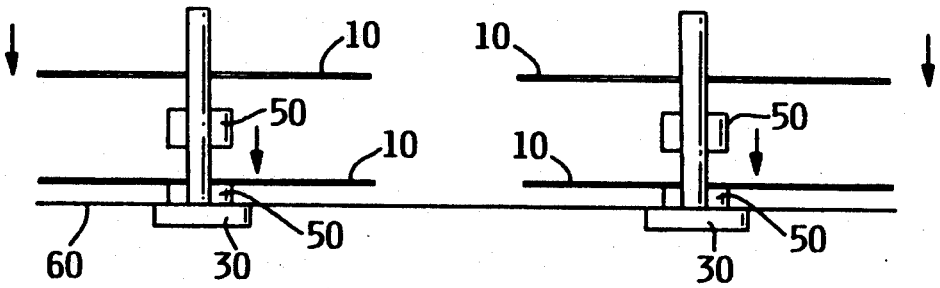
FIG. 3 (PRIOR ART)
FIG. 3 shows one stage in the construction of the prior art fan element assembly of FIGS. 1 and 2.

FIG. 3 shows one stage in the construction of the prior art disk assembly described above. At the stage shown, non-apertured disk 60 has been placed onto bolts 30, followed by one set of spacers 50. An apertured disk 10 has then been positioned, and will be followed by a further set of spacers 50, the next disk 10 and so on. It will be clear that this is a time consuming process, requiring a large number of small and intricate components.

Figure 4:
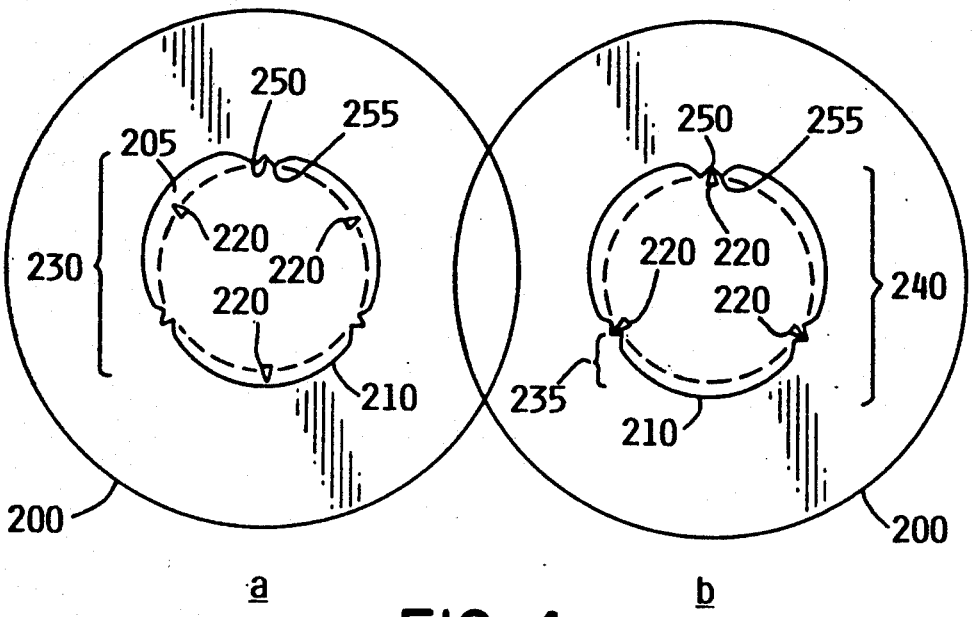
FIGS. 4*a* and 4*b* show the central aperture in a fan element according to the invention.

Refer now to FIGS. 4*a* and 4*b* which show one embodiment of a fan element for use in a fan according to the present invention. The element shown is an annular disk 200, although once again a frusto-conical or other shape of element could be used. The central aperture 210 of disk 200 is deliberately not circular, but instead has a lobed shape. For clarity, the lobes are shown exaggerated in the figures.

The purpose of the non-circular aperture is as follows. The aperture shape is such that there is sufficient clearance 205 for the disk 200 to be placed over a plurality of support posts 220 in a first position 230, as shown in FIG. 4*a*. As the disk 200 is rotated towards a second position 240 (FIG. 4*b*), the clearance between the edges of the aperture and the support posts reduces until the support posts are forced against the aperture edges. The rotation is continued until position 240 is reached, when the support posts engage with notches 250 in the aperture edge. The disk is latched securely in position 240.

It will be understood that as the disk is rotated towards position 240, the disk is locally narrower (region 255, FIG. 4*b*) than the spacing of the support posts. Therefore the posts and/or the disk must be temporarily deformed during this stage of the rotation. This temporary deformation can be accommodated by the use of a resilient or deformable material for the posts and disk. Once the posts are installed in their corresponding notches 250, this deformation is greatly reduced or eliminated. It may be advantageous to maintain some slight deformation or stress on the arrangement, in order to hold the disks more firmly in place.

In the particular example shown in FIGS. 4*a* and 4*b*, the support posts are disposed 120 degrees apart. The disk 200 is placed over the posts in position 230 and then rotated by 60 degrees to orientation 240. It is then held in position 240 by notch 250 interlocking with the support posts.

Figure 5:
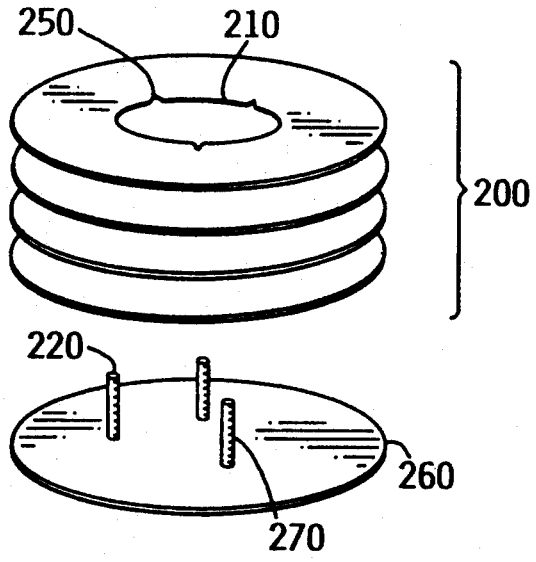
FIG. 5 shows a perspective view of one stage of the manufacture of an assembly of elements for use in a fan according to the invention.

FIG. 5 shows a perspective view of one stage in the manufacture of a fan according to the invention. An assembly of disk 200 is shown, with the disks temporarily held in a suitable spaced apart relationship by a suitable jig (not shown) and with all of the disk apertures 210 aligned. A further, non-apertured, disk 260 (corresponding to disk 60 in FIGS. 1 to 3) has three support posts attached at 120 degree intervals. The stack of disks 200 and the further disk 260 are offered up to one another such that the support posts attached to disk 260 are placed into apertures 210 in a position corresponding to position 230 (FIG. 4*a*). The support posts are fully inserted into the stack of disks 200, and then the stack of disks is rotated with respect to the support posts 260 by sixty degrees, to a relative position corresponding to position 240 in FIG. 4*b*. The disks are locked into this position by notches 250 engaging with the support posts; the temporary holding means may then be removed.

In FIG. 5, the support posts are shown with guide slots 270 disposed along their lengths. These slots guide the fan elements in order to maintain the elements in the desired spaced apart relationship. The use of guide slots 270 removes the need for spacers during assembly of the fan.

It will, therefore, be seen that the stage of the fan manufacture described in connection with FIGS. 4a, 4b, and 5 is very much simpler than the corresponding prior art process described earlier. Assembly of the new fan lends itself to automation; in particular, once a stack of disk is held in a temporary jig, a robot arm could carry disk 260, with its associated support posts, insert disk 260 into the stack, and turn disk 260 through 60 degrees with respect to the stack, in one simple operation. The jig could then be released and the complete disk assembly taken to the next stage of manufacture.

Figure 6:
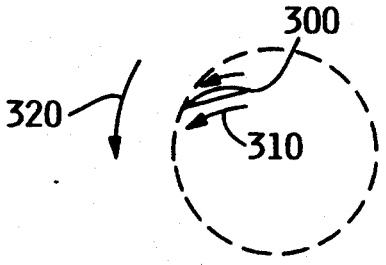
FIG. 6 shows a support post for use in the assembly of fan elements shown in FIG. 5.

The fact that the support posts are outside the active area of the disks reduces the fluid turbulence and disk noise. The turbulence may be reduced further by using a preferred shape of support post, as shown in FIG. 6. The support post 300 is a wing-like member having an elongate cross section and which is shaped to follow the air flow direction 310, given the direction of rotation 320 of the disk in operation. The most appropriate shape, to minimize disturbance of the fluid flow, could be determined using well known computer modeling techniques.

Figure 7:
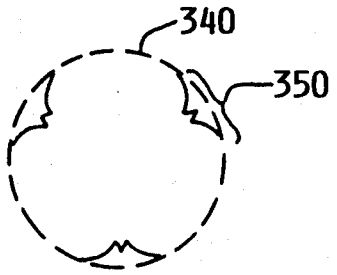
FIG. 7 shows an alternative shape for the fan element aperture.

FIG. 7 shows one of the many possible alternative shapes for the central aperture of the fan element. In the figure, an aperture 340 is shown which is substantially circular except for three locally narrower regions 350. These regions are notched as described above.

Figure 8:
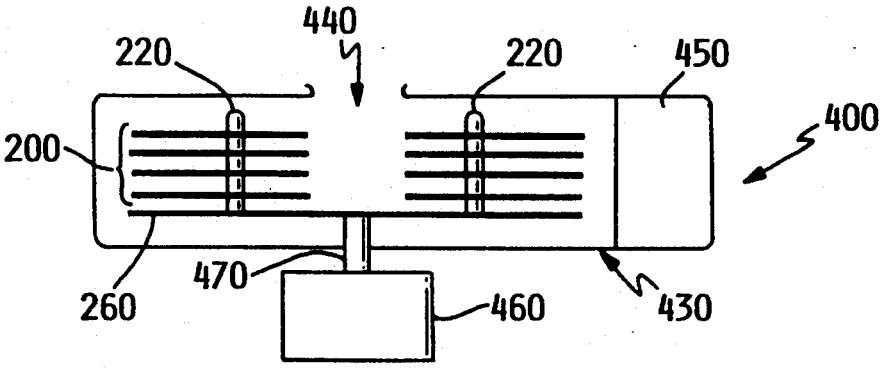
FIG. 8 shows a schematic view of a laminar flow fan according to the invention.

FIG. 8 shows a schematic view of a complete laminar flow fan 400 according to the present invention. The fan comprises a number of disks 200 attached to support posts 220. The disk and post assembly may be enclosed by a voluted case 430 having an inlet aperture 440 and outlet aperture 450. The inlet aperture 440 is positioned to allow the fluid to pass down the center of the disk assembly. The fluid is then impelled to the periphery of the disk assembly before being exhausted through the outlet aperture 450. It will be appreciated that, depending on the application for which the fan is used, a fan according to the invention may not include a case 430. A motor 460 is provided to drive the disk via shaft 470.

Although the invention has been described in respect of a particular embodiment, it will be appreciated by the skilled man that various changes could be made without departing from the scope of the invention.

I claim:

1. A laminar flow fan comprising:

a plurality of fan elements, each having a central aperture therein; and a support member passing through the central aperture in each element, wherein relative rotation of the support member from a first position to a second position with respect to the fan elements fastens the support member to an aperture edge in each element, thereby maintaining the support member and elements in the second relative position.

2. The laminar flow fan of claim 1, wherein the support member includes locating slots therein, said locating slots used to locate and maintain the fan elements in a spaced apart relationship.

3. A laminar flow fan as claimed in claim 2, wherein the aperture in at least one of the fan elements includes at least one notch with which the support member is latched into engagement when the support member and elements are in the second relative position.

4. A laminar flow fan as claimed in claim 3, wherein the support member has an elongate cross section, substantially aligned with the direction of fluid flow past the support member during operation of the fan.

5. A laminar flow fan as claimed in claim 3, in which the central aperture of each element is non-circular.

6. A laminar flow fan as claimed in claim 1, further comprising a common substructure, said support member fixed to said common substructure.

7. A laminar flow fan as claimed in claim 6, wherein a plurality of support members are attached to said common substructure, each of said support members passing through and fastening to the central aperture in each of the fan elements.

8. A laminar flow fan as claimed in claim 7, wherein the central aperture in each fan element is non-circular.

9. A laminar flow fan as claimed in claim 1, wherein each fan element is substantially annular in shape.

10. A laminar flow fan comprising:

a substructure;

a support member attached to said substructure, said support member having guide slots therein; and a fan element having a non-circular aperture therein, said support member passing through said aperture and said fan element engaging said support member.

11. The laminar flow fan of claim 10 wherein the fan element includes a portion which engages said guide slots.

12. The laminar flow fan of claim 11 further including a plurality of support members attached to said substructure, each of said support members having guide slots therein, wherein each of said plurality of support members extends through the aperture in the fan element and wherein the fan element engages a corresponding guide slot.

13. The laminar flow fan of claim 12 wherein the aperture in the fan element is shaped so that the fan element will not engage the guide slots in a first position and will engage a corresponding guide slot in a second position.

* * * * *